United States Patent [19]

Harbauer

[11] 4,437,720

[45] Mar. 20, 1984

[54] SCREWLESS TERMINAL

[75] Inventor: Werner Harbauer, Schwandorf, Fed. Rep. of Germany

[73] Assignee: Siemens Aktiengesellschaft, Munich, Fed. Rep. of Germany

[21] Appl. No.: 321,615

[22] Filed: Nov. 16, 1981

[30] Foreign Application Priority Data

Nov. 24, 1980 [DE] Fed. Rep. of Germany ..... 3044133

[51] Int. Cl.[3] ..... H01R 4/48

[52] U.S. Cl. ..... 339/95 D

[58] Field of Search ..... 339/78 R, 95 D

[56] References Cited

U.S. PATENT DOCUMENTS

| | | | |
|---|---|---|---|
| 3,937,548 | 2/1976 | Dittmann | 339/95 D |
| 4,036,545 | 7/1977 | Mysiak et al. | 339/95 D |
| 4,095,868 | 6/1978 | Luithle | 339/95 D |

FOREIGN PATENT DOCUMENTS

| | | | |
|---|---|---|---|
| 1251399 | of 0000 | Fed. Rep. of Germany . | |
| 1898970 | of 0000 | Fed. Rep. of Germany . | |
| 1905379 | 2/1969 | Fed. Rep. of Germany | 339/95 D |
| 1575118 | 4/1970 | Fed. Rep. of Germany | 339/95 D |
| 2706482 | 8/1978 | Fed. Rep. of Germany | 339/95 D |
| 3019149 | 11/1981 | Fed. Rep. of Germany | 339/95 |
| 6803194 | 9/1968 | Netherlands | 339/95 D |

*Primary Examiner*—Gil Weidenfeld
*Assistant Examiner*—Paula Austin
*Attorney, Agent, or Firm*—Kenyon & Kenyon

[57] ABSTRACT

A screwless wiring or connecting terminal for electric conductors is disclosed. According to the invention, a clamping spring of the leaf type is secured in a housing such that it can be tensioned in ring- or hairpin-fashion. One end of the spring can be detented in a cocked position by a detent associated with the spring. A conductor can be clamped between the one end of the spring and the housing when one end of the spring is released. A terminal according to the invention has the advantage that the spring terminal can be supplied from the factory in a cocked position, so that it is not necessary for the customer to apply high forces to insert and clamp a conductor. Terminals according to the invention are particularly well-suited for use in equipment having a large number of terminals, such as electromagnetic switchgear.

12 Claims, 2 Drawing Figures

SCREWLESS TERMINAL

BACKGROUND OF THE INVENTION

The present invention relates to a screwless wiring or connecting terminal for electric conductors.

In known screwless terminals, it is necessary either to insert the conductor itself into the spring terminal while applying a relatively high pressure (see for example DE-AS No. 1 251 399) or to open the terminal using a tool, for example a screwdriver, and applying a relatively high pressure to the terminal while the conductor is introduced (see for example DE-GM No. 1 898 970). Such force is necessary in any case if conductors or litz wire with fine wires without an end sleeve must be clamped in the terminal.

Also known is a terminal which can be opened by a separate plunger under relatively high pressure in order to insert the conductor.

Although those terminals can be used in electric switchgear, it is extremely difficult, cumbersome and time consuming to insert and engage the conductors, particularly where the switchgear is installed in poorly accessible areas, for example as a large number of terminals of auxiliary conductors which are arranged on a mounting plate. The reason for this is that it is practically impossible to apply a relatively high pressure to open the spring terminal while at the same time inserting the conductor into the poorly accessible terminal. Another disadvantage of known terminals is the considerable force required to insert the conductors, which leads to fatigue of the installing personnel, especially in the installation of new equipment where large numbers of terminals are involved.

OBJECTS AND SUMMARY OF THE INVENTION

It is an object of the invention to provide a terminal which can be operated simply, particularly when first connected, without requiring the application of a high force when inserting a conductor. It is another object of the invention to provide such a terminal which requires little material to manufacture, and additionally, a termainal which is simple and economical to manufacture and assemble.

These and other objects are achieved in accordance with the invention by providing a clamping spring in a screwless terminal which can be tensioned into a cocked position so that a conductor can be inserted into the terminal without the application of force while the spring is cocked. Thereafter, the spring is released and engages the conductor.

According to one aspect of the invention, the spring includes a detent arrangement for releasably cocking the spring. The detent arrangement allows the spring to be released by flexing the spring. The spring has a first end which can be tensioned and engaged by the detent to releasably cock the spring. Upon releasing the one end from its cocked position, a conductor can be clamped by the one end. The detent can comprise a recess or a lug which engages the first end of the spring.

The invention provides the advantage that the terminal can be shipped from the factory in an open condition (cocked position of the spring), so that the customer need not apply the force necessary to tension the spring to cock it. Thus, the conductor can be inserted into the terminal without the application of any force by the customer. The installation of the conductor is therefore relatively simple. It is merely necessary to insert the conductor into the terminal and to thereafter release the spring. No coordination between the application of pressure to the terminal and the simultaneous insertion of the conductor is necessary. Furthermore, no additional parts such as wedges or rotatably supported locking parts for locking the conductor in the terminal are necessary since the clamping spring itself takes over both functions, namely the latching function and the clamping function. In addition, in accordance with another aspect of the invention, the clamping spring engages the conductor such that a relatively high pull-out force is required to remove the conductor since an engaging or self-locking force is generated between the conductor and the clamping spring when an axial or pull force is exerted on the conductor.

According to another aspect of the invention where solid wires are used, as for example in housewiring, the terminal can be closed automatically by flexing the spring directly by the conductor to release the detent.

According to another aspect of the invention, the clamping spring can be opened (cocked) as well as released in the field. Openings are provided in the housing registered with ends of the clamping spring in order to provide access to the spring for cocking and releasing.

In order to make assembly of the spring more or less independent of manufacturing tolerances of the spring, in one embodiment the clamping spring is provided with a detent lug which is sheared-out.

In the disclosed embodiment, the need for additional structure to secure the clamping spring in the housing is avoided by detenting the clamping spring in a recess of the housing. In addition, further structure associated with an equipment connection strip can be avoided by inserting the equipment connecting strip into the housing recess. The connection strip has cut-outs registered with the housing openings to provide access through the strip to the spring. Preferably, at least one end of the clamping spring rests against the equipment connecting strip during operation of the equipment.

The above and other objects, features, aspects and advantages will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like numerals indicate similar parts and in which.

DESCRIPTION OF THE PREFERRED EMBODIMENT

Referring more particularly now to the drawings, embodiments of terminals according to the invention are illustrated.

Figure 1:
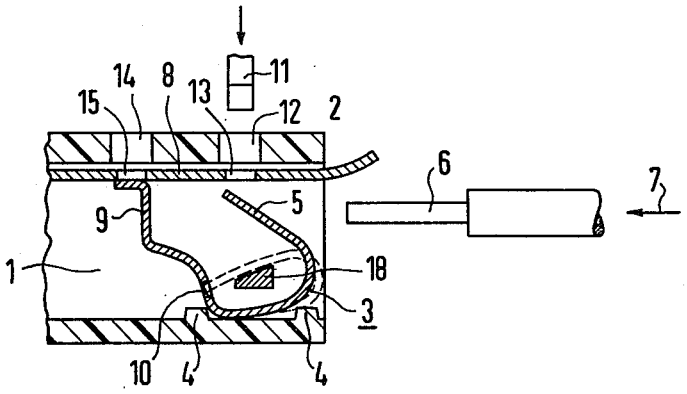
FIG. 1 is a sectional view of an embodiment of a terminal according to the invention in which the clamping spring has a slot or a recess for detenting one end in a cocked position thereof.
Figure 2:
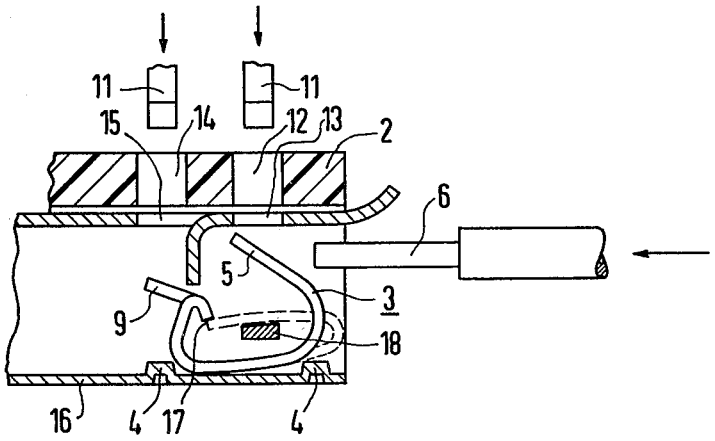
FIG. 2 is a sectional view of another embodiment of a terminal according to the invention in which the clamping spring has a sheared-out lug for detenting the one end of clamping spring in a cocked position.

In the terminal shown in FIG. 1, a clamping spring 3 is detented between projections 4 in a recess 1 of an equipment housing 2, which may, for example be the housing of electromagnetic switching equipment. One end 5 of the leaf-shaped clamping spring in the uncocked position thereof (shown in solid lines) clamps a conductor 6 against a conductive connective strip 8. The conductor 6 is inserted into the recess in the direction of the arrow 7. Current is conducted via the equipment connecting strip 8 disposed in the housing recess 1. The other end 9 of the clamping spring 3 rests, with an angled-off end, against the equipment connecting strip 8 generally parallel to the one end 5, and has spaced from the end 5 a slot-shaped opening or recess 10 into which the end 5 can be inserted and detented upon tensioning the end 5.

A screw-driver blade 11 can be introduced into a housing opening 12, which is opposite the clamping spring end 5 and is lined up with a cutout 13 in the equipment connecting strip, to cock and detent the one end 5 in the slot-shaped recess 10. During the cocking operation, the free end 5 of the clamping spring 3 is flexed and cocked, and then snaps into the recess 10 (as shown by dashed lines). The conductor 6 can then be inserted into the recess. Thereafter, a screwdriver can be inserted into the housing opening 14 which is lined up with the cutout 15 in the equipment connecting strip 8 to flex the other end 9 of the clamping spring, thereby releasing the one end 5 of the clamping spring. The released end 5 pushes the conductor 6 against the equipment connecting strip 8 and engages it thereat.

The spring is configured such that the conductor extends in the recess past the free end of the spring with the edge of the spring end facing away from the direction of entry of the conductor. This arrangement provides a self-locking feature.

To release the conductor, the screwdriver merely is inserted again into the housing opening 12 to tension and detent (via the conductor 6) end 5 of the clamping spring 3 in the slot-shaped recess 10, so that the conductor 6 can be removed freely. A strut 18 in the housing prevents plastic deformation and overelongation of the spring.

The embodiment illustrated in FIG. 3 differs from that illustrated in FIG. 1 in that the equipment connecting strip is provided as a metal cage 16, so that the forces exerted by the clamping spring do not act on plastic of which the housing can be constructed. Also, the slot-shaped recess 10 is replaced by a sheared-out lug 17, and the other end 9 of the spring is angled-off to present a contact surface for the screwdriver blade 11. The projections 4 are embossed in the metal cage 16 rather than in the housing proper. A depending flange portion is provided in the upper part of the metal cage 16 to assist in seating and securing the clamping spring.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purpose of the disclosure without departing from the spirit and scope of the invention.

What is claimed is:

1. A screwless wiring or connecting terminal comprising a housing, a leaf-type clamping spring configured and secured in the housing so that a first end of the spring can be tensioned from an uncocked position into a releasable cocked position in which the first end of the spring extends toward an adjacent portion of the spring, and a detent disposed in the adjacent portion of the spring configured to releasably retain the first end of the spring in the cocked position, there being a predetermined clearance between the first end of the spring and the interior of the housing in the cocked position of the spring such that a conductor can be inserted therebetween without having to overcome any spring tension, the first end and the housing being adapted when in the uncocked position of the spring to engage a conductor inserted therebetween.

2. The terminal according to claim 1 wherein the detent comprises an opening in the spring.

3. The terminal according to claim 1 wherein the detent comprises a projection extending from the spring.

4. The terminal according to claim 1 and including a strut 18 disposed in the housing so as to limit the extent to which the first end of the spring can be tensioned.

5. The terminal according to claim 1 wherein the housing has an opening therein providing access to the first end of the spring.

6. The terminal according to claim 1 wherein the spring has a second end which engages the housing and maintains the spring secured in the housing in cooperation with the detent.

7. The terminal according to claim 1 and comprising a connecting conductor strip disposed in the interior of the housing opposite the first end of the spring, the first end and the conductor strip being adapted when in the uncocked position of the spring to engage a conductor inserted therebetween.

8. The terminal according to claim 1 wherein the detent is disposed so as to be contacted by a conductor inserted into the housing between the housing and the first end of the cocked spring to release the first end of the spring.

9. The terminal according to claim 1 wherein the spring has a second end and is configured and secured in the housing such that tensioning of the second end releases the first end from the detent thereby permitting the first end to flex into its uncocked position.

10. The terminal according to claim 1 or 9 including spaced projections in the housing which prevent movement of the spring during tensioning.

11. The terminal according to claim 9 wherein the housing has at least one opening therein providing access to the first and second ends of the spring.

12. The terminal according to claim 11 and comprising a connecting conductor strip disposed in the interior of the housing opposite the first end of the spring, the first end and the conductor strip being adapted when in the uncocked position of the spring to engage a conductor inserted therebetween, the conductor strip having at least one opening which registers with the at least one opening of the housing.

* * * * *